United States Patent [19]

Proch

[11] Patent Number: 4,951,489

[45] Date of Patent: Aug. 28, 1990

[54] KEY HOLDER

[76] Inventor: Nathan C. Proch, 2935 Marshall Ave., Apt. #16, Cincinnati, Ohio 45220

[21] Appl. No.: 372,541

[22] Filed: Jun. 26, 1989

[51] Int. Cl.[5] ..... A47G 29/10

[52] U.S. Cl. ..... 70/456 R

[58] Field of Search ..... 70/456 R, 456 B, 459; 154/40; 24/3 K

[56] References Cited

U.S. PATENT DOCUMENTS

| | | | |
|---|---|---|---|
| 2,038,070 | 4/1936 | Welch | 150/40 |
| 2,228,726 | 1/1941 | Loesch | 70/456 B |
| 2,291,896 | 8/1942 | Henderson | 70/456 |
| 2,344,581 | 3/1944 | Ziegeweid | 70/456 |
| 2,964,937 | 12/1960 | Lautin | 70/456 |
| 2,969,823 | 1/1961 | Sherwood | 70/456 B |
| 3,212,546 | 10/1965 | Lind | 150/40 |
| 3,279,513 | 10/1966 | Henderson | 150/40 |
| 3,407,636 | 10/1968 | Kovacevic | 70/456 |
| 3,587,262 | 6/1971 | Kaye | 70/456 |
| 3,606,777 | 9/1971 | Watson | 70/458 |
| 3,677,044 | 7/1972 | De Frees | 70/456 R |
| 4,571,967 | 2/1986 | Jacobsen | 70/456 R |

*Primary Examiner*—Robert L. Wolfe

*Attorney, Agent, or Firm*—Wood, Herron & Evans

[57] ABSTRACT

A key holder which has a pair of shells for enclosing the keys which are connected together by a spring-loaded locking hinge. The keys are connected to the shells by at least one arm attached to one of the shells. The keys can be stacked on top of each other inside the key holder. The spring-loaded locking hinge generally holds the shells in a closed position relative to each other. This is accomplished by a knob on one part of the hinge which engages with a notch on another part inside the hinge. A spring kept in torsion and compression tends to urge the shells open so that when a button on the end of the hinge is pressed, the knob disengages the notch and the spring causes the shells to open.

2 Claims, 6 Drawing Sheets

KEY HOLDER

BACKGROUND OF THE INVENTION

1. Field of the Invention

The present invention relates generally to key holders and, more particularly, is concerned with a device which has a spring-loaded locking hinge, and is capable of holding a relatively large number of keys in a streamlined fashion.

2. Description of the Prior Art

Most individuals carry a number of keys on a daily basis, including keys to their homes, automobiles, and the like. There have been numerous attempts to create devices for effectively managing these keys. These attempts range from the simple "key ring" to more elaborate devices such as those described below. However, none of the existing devices, are particulary suitable, for one reason or another, for serving their intended purpose.

For instance, although the typical key ring serves to hold a number of keys together and is relatively easy to use in that keys can be readily placed upon or removed from the ring, it is also quite bulky and, if a number of keys are placed on the ring, inconvenient and uncomfortable for placement in a person's pocket.

Other devices designed to eliminate this problem often attempt to provide some sort of enclosure for the keys in which the keys are aligned relative to one another so they can be carried in a compact fashion. However, these latter devices suffer from a number of drawbacks, including the limitations that: they are incapable of holding the number of keys most individuals carry; that it is often difficult to retrieve the particular key needed; they do not have a convenient method for returning keys to the key holder after use; they frequently have latches or other sharp protrusions which make them unsuitable for placing inside one's pocket; or, are of such size or shape that they will not fit comfortably in one's pocket.

For example, U.S. Pat. No. 2,228,726 to R. L. Loesch and U.S. Pat. No. 3,407,636 to B. N. Kovacevic disclose key holders which are generally capable of holding a total of only six keys. Six keys appears to be the practical limit for most of the prior enclosure-type devices developed for holding keys. In addition, because the manner of the attachment of the keys to the key holder requires that the keys be placed in a side-by-side relationship, they are rather unusually shaped and inconveniently sized. Both are of a size which is either substantially longer than the length of a typical key, or of a width substantially greater than that of two keys lying side by side. Further, the key case described in the Loesch patent is held in a closed position by a snap catch which, as in some of the other patented inventions described below, is a protrusion on the surface of the same which could catch on the user's clothing or be inadvertently released so the case would come open. In the other patent, the Kovacevic patent, the number of working parts contributes to the sheer bulkiness of the overall dimensions of the case which does not result in a great improvement over carrying the keys on a key ring.

The key holders described in U.S. Pat. No. 3,677,044 to Paul T. De Frees, and U.S. Pat. No. 4,571,967 to Stephen C. Jacobsen, are generally capable of holding only three to four keys. The first version of the key holder illustrated in the Jacobsen patent can be modified, however, to include arms for holding keys on the other side of the "floor" portion of that invention to double the key holding capacity. If the Jacobsen device were so modified, the keys would still have to be placed side by side, and three across, similar to the devices described in the preceding paragraph. The key holders disclosed in the De Frees and Jacobsen patents also have protrusions which make them unsuitable for placing inside the user's pocket. In the De Frees patent, there are latches which hold the lids closed which project from the surfaces of the case. In the Jacobsen patent the keys are held against a flat floor or base, and are partially covered by the arms to which the keys are attached. Despite the fact that the arms partially cover the keys, the arms and the uncovered portion of the keys as well as the divider walls which separate the keys on the different arms are exposed inside the user's pocket. This could result in the keys snagging material in the user's pants pocket, and could cause injury to the user when reaching into his pocket.

Further, a number of the inventions referred to above do not have a convenient mechanism either for selecting the desired key or for returning the keys back to the enclosure after use. Of the devices which have a way to select a key and return the same to the case after use, the mechanism employed is often needlessly mechanically complicated and contributes unecessarily to the overall dimensions of the case or holder. Without specifically describing the mechanisms for returning the keys to the case in all of the patents referred to above, it is apparent that in order to select a key in a device such as that described in the Jacobsen patent, both hands would be needed to hold the case and to unlatch the arms which have been folded against the floor or base of the key holder shown therein. Likewise, after each use, it would be inconvenient to have to align the keys, and then lay the keys flat against the floor and then fold the arms over the keys. Such manuevering of the keys would be particularly difficult in the dark or with one hand which are frequently the conditions under which one must struggle to find one's keys. It is therefore necessary to design a key case which permits the keys to easily retrieved and folded back into the case after each use in a natural manner which does not involve unecessary mechanical complications.

Additionally, it is apparent from viewing the drawings of the previously patented enclosure-type key holders, that although attention was apparently devoted to holding the keys in place with respect to each other, a relatively insignificant effort was spent in attempting to make the key holders in a shape which would fit comfortably in one's hand, and to make the overall shape of the key holder appealing and attractive.

Consequently, a need exists for a key holder which is capable of enclosing a large number of keys in a streamlined fashion and which permits easy access to the keys desired to be used and has no latches or other sharp protrusions on its exterior.

SUMMARY OF THE INVENTION

With the above background in mind, it is an object of the present invention to provide a device for holding one's keys which overcomes the above-mentioned drawbacks of known prior art devices.

Specifically, it is a primary object of the present invention to provide a key holder which is capable of holding a relatively large number of keys in a streamlined fashion.

It is a further object of this invention to provide a key holder which has convenient means for both retrieving the particular key needed and for returning the same to the key holder after use. It is also an object of this invention to provide a means for selecting and returning the keys after use which is free from unnecessary mechanical complications.

It is also an object of the present invention to provide a key holder which is of such size and shape to enable it to fit conveniently in one's hand and in one's pocket, and which does not have any latches or surface protrusions which will make it unsuitable for placing inside one's pocket.

Another object of the present invention is to provide a key holder which capable of holding the keys inside an enclosure in a noise-free manner when they are not in use.

Finally, it is an object of this invention to provide a key holder which is lightweight, durable, economical to manufacture, easy to operate with one hand, and which is attractive in appearance.

These, as well as other objects which will become apparent as the description proceeds, are fulfilled by the present invention which is a compact key holder which completely encloses the keys inside a pair of shells when they are not being used. The shells are held together by a spring-activated locking hinge which allows the shells to open and close relative to each other. The keys are connected to the shells by arms or by another suitable means of attachment. By a mechanism which will be hereinafter described, the hinge generally holds the shells in a closed position. Access to the keys is obtained with one hand by pushing a button on the hinge with one's thumb. This moves a body inside the hinge which releases a spring inside the hinge, which in turn opens the shells. The keys on one of the arms can be revealed, the case closed, and the aforementioned keys can be used by the individual. To return the keys to the case, one merely presses the button again which opens the shells, flips the keys back inside the shells, and closes the case.

BRIEF DESCRIPTION OF THE DRAWINGS

The invention itself will be better understood, and additional advantages and features of the invention will become apparent from the following detailed description of the preferred embodiment of the invention, taken in conjunction with the accompanying drawings, in which.

DETAILED DESCRIPTION OF THE INVENTION

Figure 1:
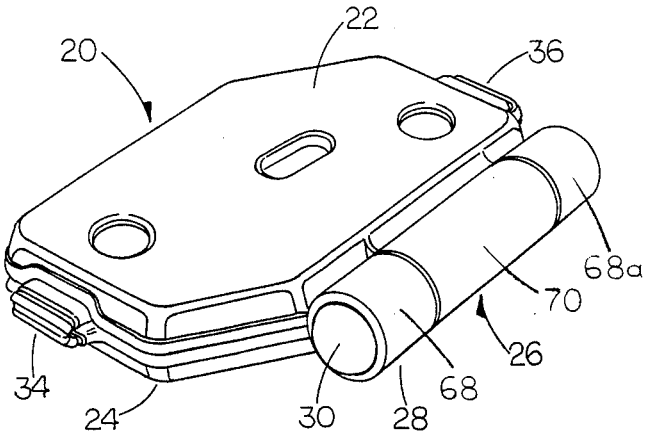
FIG. 1 is a perspective view of the key holder of the present invention shown in a closed position with the keys hidden from view inside.

Referring now to the drawings, and more particularly, to FIG. 1, there is shown a key holder, generally designated 20, which comprises the preferred embodiment of the present invention. In FIG. 1, the key holder 20 is shown in a closed position with the keys hidden from view inside. The basic elements of the key holder 20 include a pair of shells, such as top shell 22 and bottom shell 24 (which will hereinafter sometimes be referred to as simply "shell 22" and "shell 24") connected together by a hinge, such as spring-loaded locking hinge generally designated 26. The top end 28 of hinge 26 is provided with a means for activating the hinge such as the body hereinafter described, which is provided with button 30 on its end. The button 30 can be activated by the user's thumb to release a spring inside the hinge 26 to open shells 22 and 24. As will be seen in subsequent views, there is at least one arm, to which the keys are connected at the end, such as arms 34 and 36. In this figure, arms 34 and 36 are closed inside the shells 22 and 24.

Figure 2:
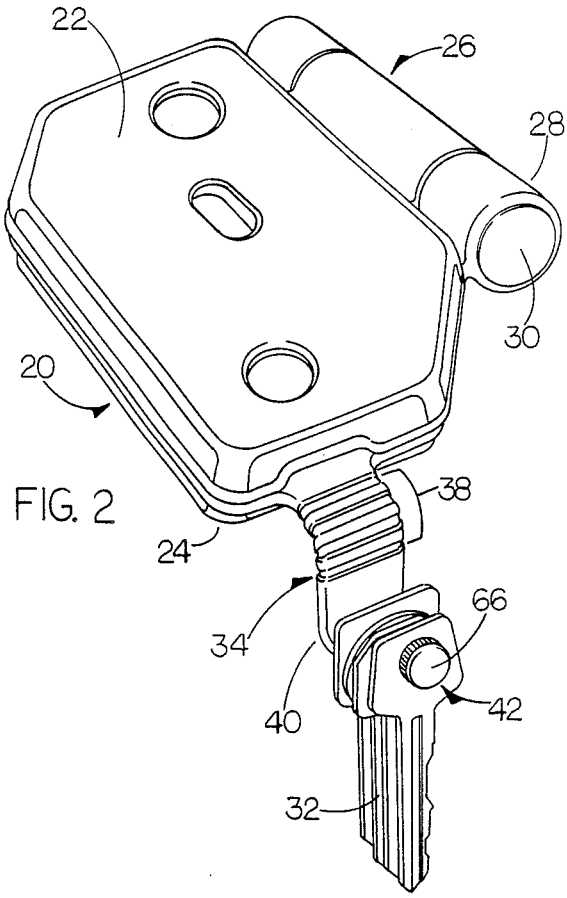
FIG. 2 is a perspective view of the key holder of the present invention showing several of the keys in position for use.

In FIG. 2, the key holder 20 is shown with the keys 32 on the end of one arm, arm 34, exposed for use. In order to arrive at this position, it was first necessary to depress button 30 to release the spring and open shells 22 and 24. Arm 34 was unfolded into its fully extended position outside of the shells 22 and 24, and shells 22 and 24 were then closed. Arms 34 and 36 are made of a flexible material, such as injection molded thermoplastic rubber, and can thus be straightened out to expose set of keys 32 for use outside the shells 22 and 24, or they can be folded so the keys will fit inside shells 22 and 24. To facilitate the ability of the arms to fold at the proper position, a section 38 of arm 24 which remains generally outside of the key holder 20 when it is closed contains alternating sections of differing thickness in the form of a "living hinge" to provide a mechanism for allowing the arms to be folded in and out of shells 22 and 24 of the key holder 20.

Figure 8:
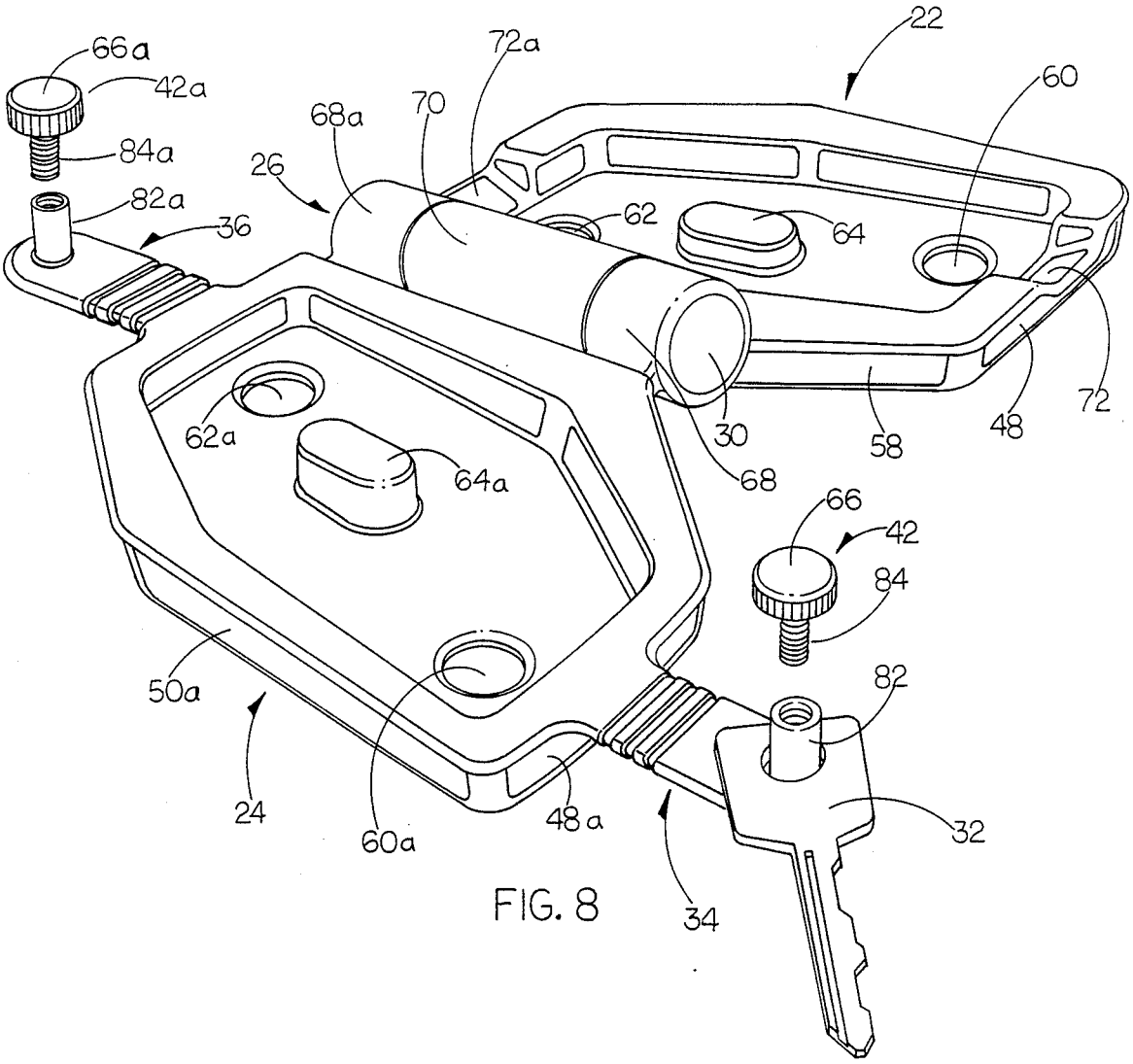
FIG. 8 is a perspective view of the key holder of the present invention shown in an open position which illustrates the manner in which the keys are placed upon the arms.
Figure 8A:
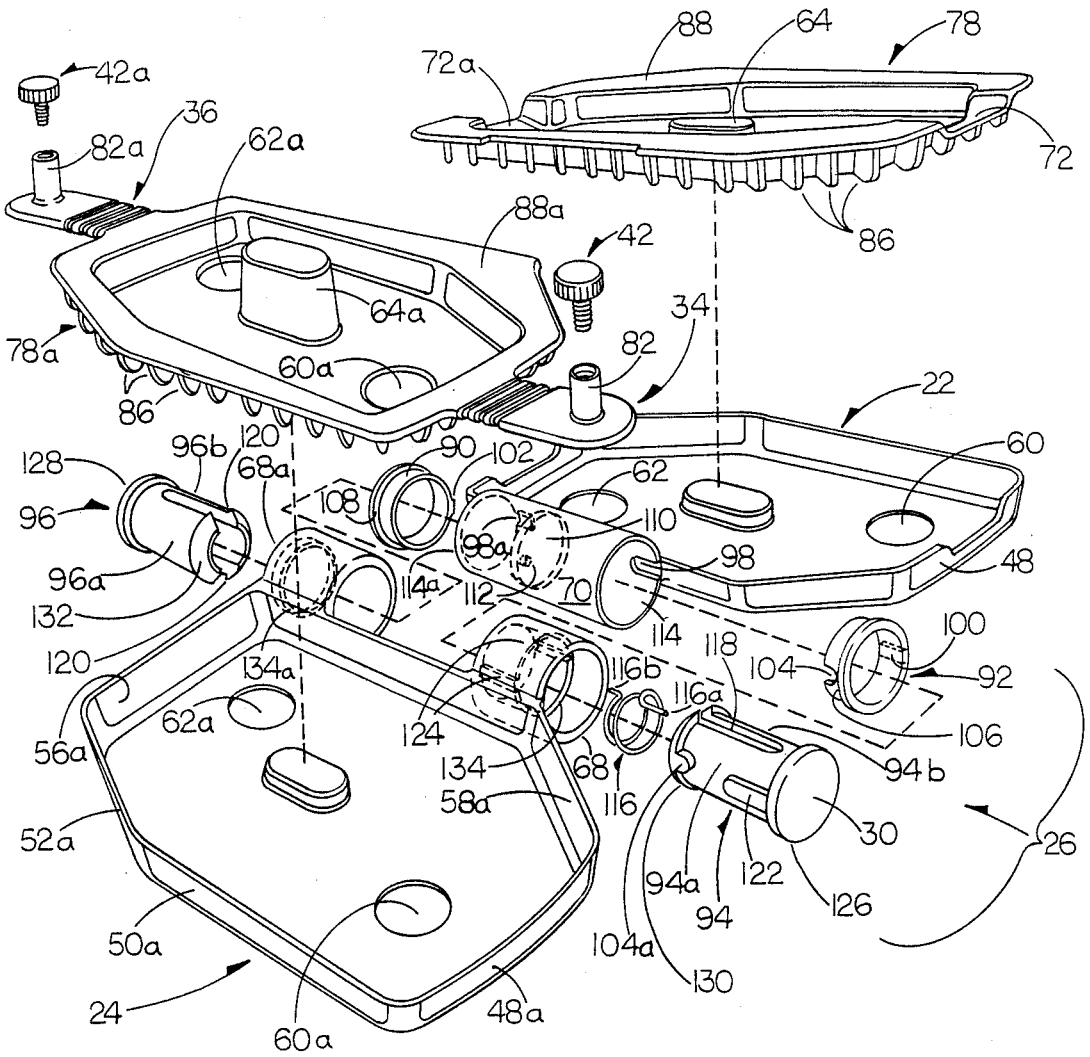
FIG. 8A is an exploded perspective view of the key holder of the present invention in open position showing the manner of the assembly of all the parts thereof.

One possible means for attachment of the keys onto the ends of the arms is also shown in FIG. 2. Although it is contemplated that keys 32 can be affixed to the end of arms 34 and 36 by any suitable means, in this embodiment of the invention, the set of keys 32 are affixed to the end 40 of arm 34 by a bolt 42 which is screwed into a threaded receptacle on arm 34. The receptacle itself is not seen in this view, however, it will be seen in numerous other figures which follow, and is best seen in FIGS. 8 and 8A. FIG. 2 also illustrates that a number of keys can be stacked on an arm, which enables the key holder 20 of the present invention to hold a larger number of keys than nearly all of the previous enclosure-type devices. In the embodiment of the invention shown in the drawings, each arm has the capacity of holding five keys. The total number of keys which can be held by the device as shown is, therefore, ten.

Figure 3:
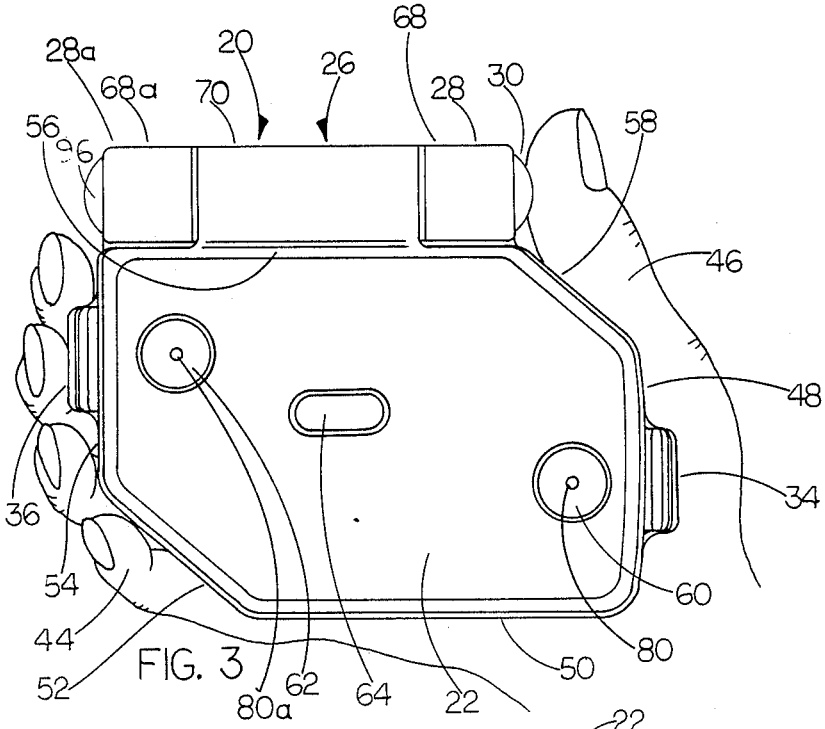
FIG. 3 is a plan view of the key holder of the present invention in closed position shown in the palm of the individual using the same.
Figure 4:
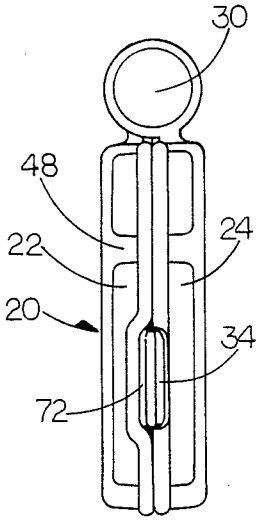
FIG. 4 is an end view of the key holder of the present invention shown in a closed position.
Figure 5:
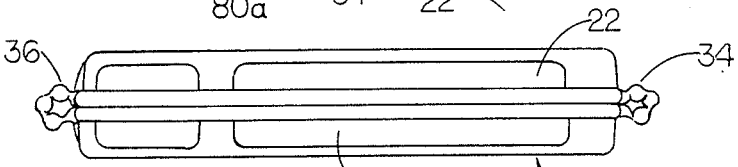
FIG. 5 is a side elevational view of the key holder of the present invention shown in a closed position.

Referring to FIGS. 3–5, features of the outside of the key holder 20 of the present invention are shown. Additionally, FIG. 3 shows the manner in which the key holder 20 of the present invention is designed to be held in the hand of an individual. In FIG. 3, a plan view of the key holder 20 of the present invention in a closed position, the configuration of the surface of shell 22 and the exterior of hinge 26 are also best seen.

The general shape of the preferred embodiment of the key holder 20 of the present invention is adapted so it can fit comfortably in one hand in such a manner that the button 30 can be reached easily and pressed in with the thumb to activate the hinge 26 and open the shells 22 and 24. Empirical data compiled on the size of the smallest average woman's hand and that of the largest average man's hand were used to develop the size and shape of the exterior of the key holder 20. As seen in FIG. 3, the key holder 20 of the present invention is being held in the palm of the right hand 44 of the aforementioned individual in such a manner that the button 30 can be pressed with the individual's thumb 46. It is to be understood, that FIG. 3 shows but one manner of holding the preferred embodiment of the present invention, and that this is not the only way to hold the invention disclosed herein. The invention can be of a different shapes than that depicted in the drawings, however, given the shape of the embodiment of the invention shown in the drawings, and the manner in which the hinge 26 opens, FIG. 3 shows the preferred way to hold the invention.

In FIG. 3, it is seen that in the preferred embodiment of the present invention, the top of shell 22, (which is a mirror image of bottom shell 24) is a six-sided polygon with adjacent sides 48, 50, 52, 54, 56, and 58. As will be seen in subsequent figures, sides 48, 50, 52, 54, 56, and 58 form the side walls of shell 22. The following description of the sides of shell 22 applies equally to the sides of shell 24, however, corresponding sides of bottom shell 24 are referred to in the figures which follow as **48*a*, 50*a*, 52*a*, 54*a*, 56*a*, and 58*a*. Sides 48, 50, and 52, and 54, 56, and 58 are of generally unequal lengths with respect to each other. However, opposite sides 48 and 54, 50 and 56, 52 and 58**, approximately the same length, and generally parallel to each other.

Hinge 26 is affixed to the edge of sides 56 and **56*a* of the key holder 20 of the present invention, and is generally parallel thereto. In the preferred embodiment of the present invention, the entire hinge 26 is slightly offset in such a manner that bottom end 28*a* of hinge 26 is nearly flush with sides 54 and 54*a* and a distance back from sides 48 and 48*a*. This offset is meant to accomodate right-handed persons. At this point it should be noted that a convention has been adopted for convenience in the drawings with regard to the top end 28 and the bottom end 28*a* of the hinge 26, and its various component parts. The end of the hinge 26 and any of its component parts closest to the button 30 will be referred to as being at the top end, and the end of the hinge 26, and any component parts at the opposite end will be referred to as being at the bottom end. It is also contemplated that left-handed persons can use the present invention by simply flipping the key holder 20** over and this change in orientation will result in a version which will be oriented in the reverse manner, however, as will be seen when the key case is opened, the keys will have a tendancy to spill out. For this reason it is also contemplated that the key case could be manufactured specifically for left-handed individuals.

With respect to the configuration of the surface of the shells, as seen in FIG. 3, there are two circular holes 60 and 62 in top shell 22. Holes 60 and 62 are located adjacent to the edges 48 and 54, respectively, of shell 22 at the points where arms 34 and 36 are folded inside shells 22 and 24. As will be first seen in FIG. 6, there are two corresponding holes **60*a* and 62*a* in bottom shell 24. Both sets of holes, 60 and 62 and 60*a* and 62*a* operate in conjunction with the means for attachment of the keys to the arms, such as bolt 42, and domed portion 80 on the end of the threaded receptacle 82, as retaining mechanisms to prevent the keys from moving around inside the key holder 20 when it is closed. The retaining mechanisms lock each of the arms, and thus the keys, in place inside the shells at two points. Holes 60 and 62 serve as receptacles for domed portions 80 and 80*a* on the back of arms 34 and 36, respectively. As seen best in FIG. 6A, domed portions 80 and 80*a* are formed on the back of arms 34 and 36 at the point where the threaded receptacles 82 and 82*a* are affixed to the arms. Domed portions 80 and 80*a* are essentially areas where surplus material has been placed to reinforce the attachment of the threaded receptacles 82 and 82*a* to the arms. As will be seen in subsequent views, corresponding holes 60*a* and 62*a* in shell 24 serve as receptacles for the heads of bolts such as the head 66 of bolt 42, and corresponding head 66*a* of bolt 42*a*** which fasten the keys to the threaded receptacles.

Boss 64 appears as an oblong hole in the center of the surface of shell 22. Unlike holes 60 and 62, in which holes have simply been cut out of the surface of shell 22, boss 64 is a projection which extends into the interior of the key holder 20. There is a similar boss in the surface of bottom shell 24 which will be seen in subsequent figures which also extends into the interior of the key holder 20. Each boss extends part of the way into the interior of the key holder 20 to meet the other boss near the center of the same to form a partition or wall between the different sets of keys to separate the two sets of keys, and to keep them from rattling.

As was mentioned previously, FIG. 3 also provides a view of the exterior of hinge 26. Referring to FIG. 3 and additionally to FIGS. 1, 2, 4, and 8A, it is seen that hinge 26 is composed generally of three hollow cylindrical portions, including top cylindrical portion 68 and bottom cylindrical portion **68*a* (which will hereinafter sometimes be referred to as simply cylindrical portions 68 and 68a, respectively), which are affixed to the exterior of wall 56 of the shell 24, and in the preferred embodiment of the present invention, are molded as part of the same unit as shell 24. The two cylindrical portions 68 and 68a are separated by central cylindrical portion 70. Central cylindrical portion 70 is affixed to the exterior of shell 22, along wall 56 of the same. The entire mechanism of hinge 26 is best seen in the figures which follow, and will be described in conjunction with those figures; however, the two end portions of the locking mechanism which hold the hinge 26 together can also be seen in FIG. 3. These are the end of retaining pin, and the button 30 which is on the end of a body, such as locking pin 94, both of which are first seen in FIG. 8A**.

In FIG. 4, an end view of the preferred embodiment of the key holder 20 of the present invention, it is seen that wall 48 of shell 22 contains a recess 72 to provide clearance for arm 34 to fold into the interior of key holder 20. As will be subsequently seen, opposite wall 54 contains a corresponding recess 72a which provides clearance for arm 36 on the other side of the key holder 20.

FIG. 5 illustrates the degree to which the living hinges on arms 34 and 36 are able to fold so the arms 34 and 36 can fit into the interior of the key case.

Figure 6:
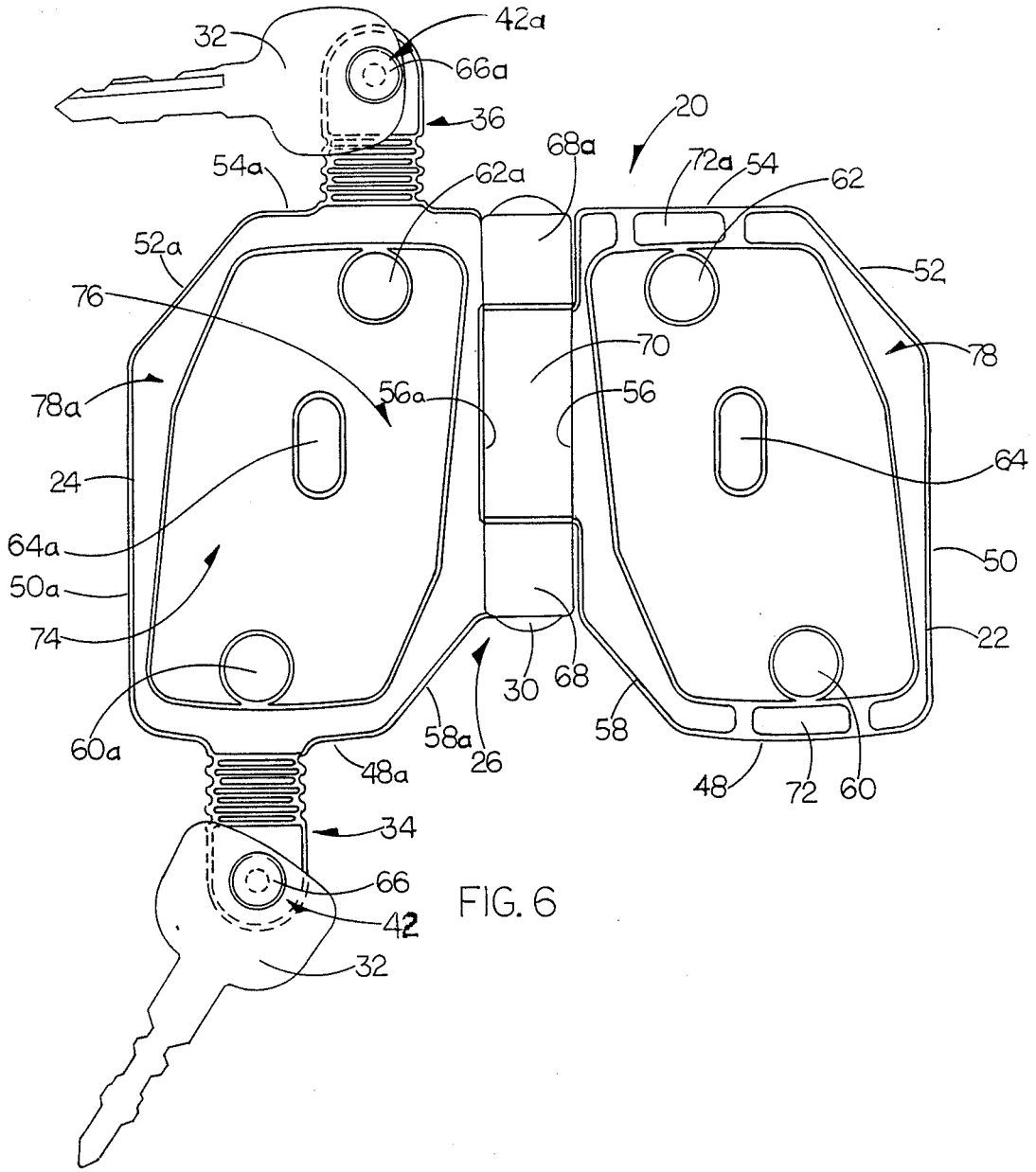
FIG. 6 is a plan view of the key holder of the present invention shown in an open position with keys attached to both of the arms which are in their fully-extended position outside of the shells.

FIG. 6 shows the key holder 20 of the present invention in an open position with both arms 34 and 36 fully extended outside the shells. The interior of shells 22 and 24 are first shown in more detail in this figure. The construction of the arms 34 and 36 and the attachment of the same to the shell 24 are also first shown in greater detail in this figure. In the preferred embodiment of the present invention, the dimensions of the interior of shells 22 and 24 do not correspond exactly with the exterior of the same because there are liners 78 and 78a which fit inside the respective shells 22 and 24. Liners 78 and 78a serve a number of purposes, including to define the space which keys are to occupy, since if the exterior of the key holder were made the exact shape of the area that the keys occupied, the overall shape of the key holder 20 would be rather awkward. The liners 78 and 78a also serve to produce a cushion effect between the outside of the shells so the keys do not rattle around inside the key holder 20.

As far as the attachment of arms 34 and 36 to shell 24 is concerned, in this embodiment of the invention, arms 34 and 36 are formed as an integral part of liner 78a, although it is contemplated that they could be separate from liner 78a, attached to shell 24 in a different fashion, or even attached to top shell 22 instead.

Figure 7:
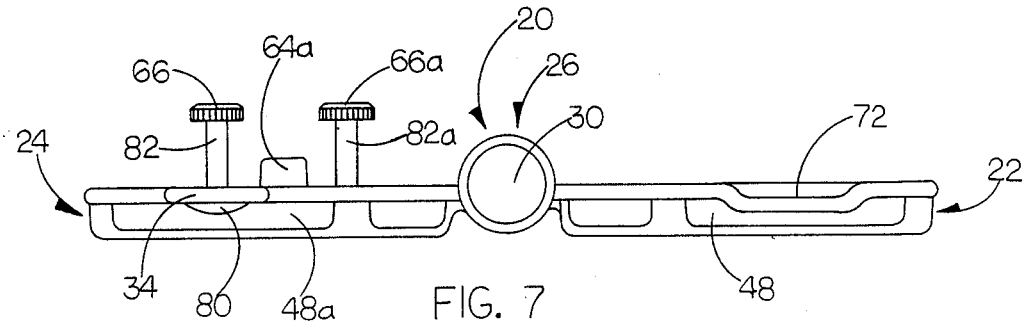
FIG. 7 is an end elevational view of the key holder of the present invention shown in an open position without the keys.
Figure 6A:
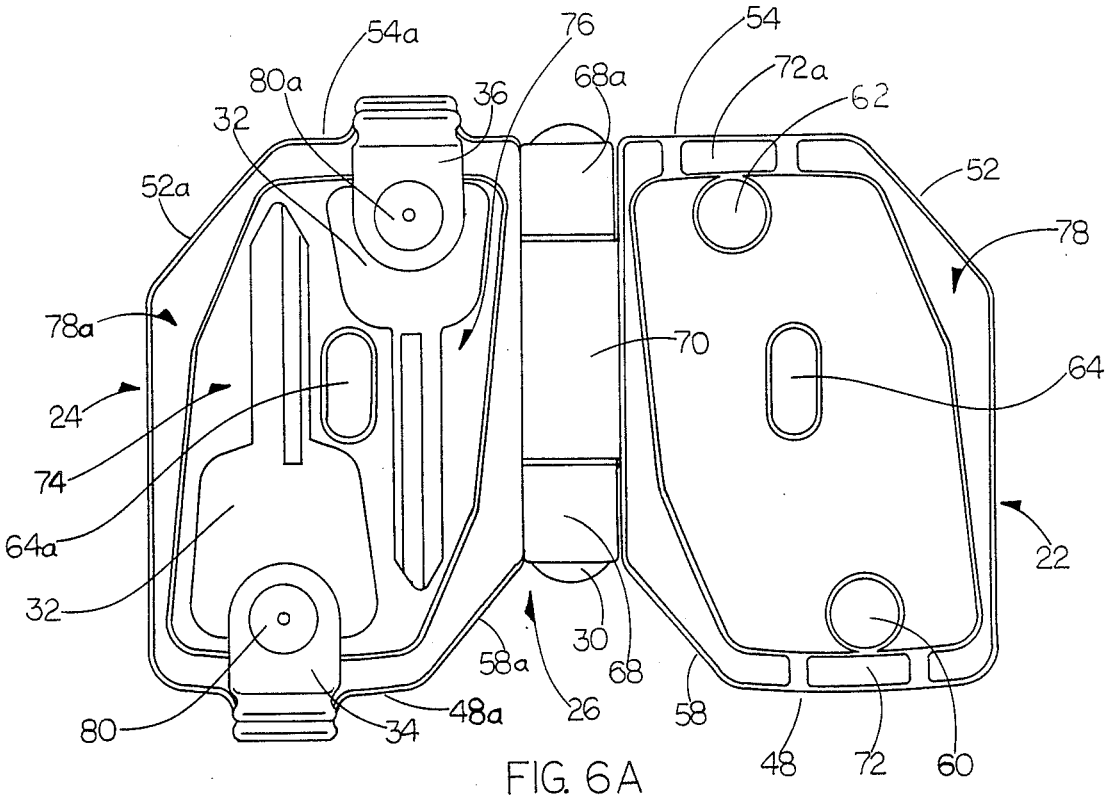
FIG. 6A on the following page is a plan view of the key holder of the present invention, similar to that of FIG. 6, only with the keys folded inside one of the shells of the key holder.

The manner in which arms 34 and 36 are folded into the interior of shells 22 and 24 from their position in FIG. 6 is shown in FIG. 6A on the following page of drawings. Both groups of keys are folded into bottom shell 24. The group of keys 32 on arm 34 fit inside of bottom shell 24 on one side of boss 64a and the group of keys on arm 36 fit on the other side of boss 64a. As seen in FIGS. 7, 8, and 8A, although the projections formed by the bosses in the shells 22 and 24 are of approximately the same size, boss 64a on liner 78a is substantially larger than corresponding boss 64 on liner 78. This is necessitated by the fact that the keys are initially folded into liner 78a inside shell 24. The larger boss 64a keeps the keys in place until shell 22 closes over the keys. Referring to FIG. 6A and to the previous FIG. 6, it is seen that arms 34 and 36 are folded over in such a manner that the heads 66 and 66a on bolts 42 and 42a fit into holes 60a and 62a respectively. When shell 22 is folded over, holes 60 and 62 will fit over the domed portions, 80 and 80a at the ends of threaded receptacles 82 and 82a, boss 64 will fit over corresponding boss 64a, and recesses 72 and 72a will provide clearance for arms 34 and 36 to fold into the interior of shell 24.

Although it is contemplated that the interior of shells 22 and 24 can be of any shape and size, it is best seen in FIG. 6A where the keys are in place inside shell 24, that in the preferred embodiment of the present invention, the length of the dimension of the space 74 which the group of keys 32 on arm 34 occupy is slightly greater than the corresponding dimension of the space 76 which the group of keys 32 on arm 36 occupy. This aspect of the invention was intended to account for the largest keys in general use, which tend to be certain car keys. It is also seen in this figure that when keys 32 are inside shell 24, they are stacked neatly on top of each other with boss 64a separating the same to keep them from rattling.

FIG. 7 is an end view of the key holder 20 of the present invention in an open position shown without any keys on the ends of the arms. FIG. 7 shows the height of the exteriors of the threaded receptacles 82 and 82a and the space for a relatively large number of keys to fit on the same.

FIG. 8 is a perspective view of the key holder 20 of the present invention shown in an open position, illustrating, among other things, the appearance of the key holder 20 in an assembled condition taken from the same angle as the exploded view which follows, and the manner in which the bolts, 42 and 42a are screwed into threaded receptacles 82 and 82a to affix the keys 32 to the arms.

FIG. 8A is an exploded perspective view of the key holder 20 of the present invention which shows the manner of assembly of its parts. In FIG. 8A, it is first seen how the liners 78 and 78a fit into the interior of shells 22 and 24 respectively. The assembly of the operative parts of hinge 26 is also first seen.

With respect to liners 78 and 78a, it is seen that they are essentially flat on the bottom, however, they have a plurality of webs 86 on their undersides which come in contact with the respective shells, 22 and 24. These webs 86 serve to support the flanges 88 and 88a formed around the perimeter of the liners 78 and 78a to keep the same in place and also to provide a series of air pockets which prevent the keys from rattling against the inside of the shells 22 and 24.

The order of assembly of the component parts of hinge 26 is shown in dashed lines. These component parts include: the two cylindrical portions 68 and 68a; central cylindrical portion 70; retaining insert 90; locking insert 92; a means for locking the hinge 26 which utilizes a body, such as locking pin 94; spring 116; and, retaining pin 96.

Examining the component parts of the hinge 26 in the order set forth above, FIG. 8A first illustrates that in the preferred embodiment of the invention, top cylindrical portion 68 and bottom cylindrical portion 68a are approximately the same diameter as central cylindrical portion 70. Additionally, cylindrical portion 68 contains a pair of key way slots 124 on its inside wall which run parallel with its axis to provide a means for guiding the longitudinal movement of locking pin 94 so that when button 30 on the end of the locking pin 94 is pressed, the locking pin 94 will move longitudinally only, and will not rotate relative to cylindrical portion 68. Both cylindrical portions 68 and 68*a* have ledges 134 and 134*a* around the inside of their perimeters which serve as stops for locking pin 94 and retaining pin 96, to prevent the locking pin 94 and the retaining pin 96 from being pushed too far in toward the center of the hinge 26 assembly. The ledge 134 which serves as a stop for locking pin 94 is slightly more recessed than the corresponding ledge 134*a*. This allows the locking pin 94 to be pushed further in toward the center of the hinge 26 so there will be greater room for longitudinal movement of button 30 on the end of locking pin 94.

Central cylindrical portion 70 in the preferred embodiment of the invention contains a wall 110 inside the center thereof with a hole 112 therein for receiving one end of spring 116. Central cylindrical portion 70 is also slotted with its own key ways 98 and 98*a* for receiving channels 100 and 102 on locking insert 92 and retaining insert 90 respectively, to assure that these parts do not rotate relative to the central cylindrical portion 70.

Retaining insert 90 and locking insert 92 are essentially hard plastic rings which serve to provide part of the means for holding cylindrical portions 68 and 68*a* to central cylindrical portion 70. Both retaining insert 90 and locking insert 92 contain lips 108 and 106, respectively, around their perimeters to assure that they will not be forced more than a certain distance inside central cylindrical portion 70. As mentioned above, retaining insert 90 contains channel 102 on the outside of its wall, and locking insert 92 also contains a channel 100 on the outside of its wall which fit into the corresponding key ways 98*a* and 98 inside central cylindrical portion 70.

Additionally, in the preferred embodiment of the invention, there is a notch 104 on the bottom end of locking insert 92. This notch can also be located on the inside of any of the three hollow cylindrical portions, or elsewhere on the hinge. The notch 104 functions in conjunction with the means for locking the hinge, which in the preferred embodiment of the invention, is a projection, such as knob 104*a* on the outside of the locking pin 94, which fits into the notch 104 to lock the hinge 26 and thus the shells 22 and 24, together.

Locking pin 94 and retaining pin 96 are generally in the shape of hollow cylindrical tubes. Both locking pin 94 and retaining pin 96 have caps 126 and 128, respectively, on the one end which is facing the outside of the hinge 26, which cooperate with ledges 134 and 134*a* on the insides of cylindrical portions 68 and 68*a* to limit the distance locking pin 94 and retaining pin 96 can be pushed inside cylindrical portions 68 and 68*a*. At the other ends, locking pin 94 and retaining pin 96 have lips, 130 and 132, around their outside which serve to lock cylindrical portions 68 and 68*a* to the central cylindrical portion 70 by engaging locking insert 92 and retaining insert 90. In addition, both have a pair of longitudinal slots, 118 and 120 respectively, which divide the bodies of the locking pin 94 and the retaining pin 96 into halves in such a manner that each body is in the shape of a pair of prongs. The prongs formed on locking pin 94 are numbered 94*a* and 94*b*, and the prongs formed on retaining pin 96 are numbered 96*a*and 96*b*. The slots 118 and 120 which form the prongs in general are tapered, and are wider near the ends of the respective locking pin 94 and retaining pin 96 adjacent to the lips 130 and 132. The tapering of the slots allows the prongs to be squeezed together so the lips 130 and 132 on the ends of the same will be able to clear the interior edges of locking insert 92 and retaining insert 90, respectively when locking pin 94 and retaining pin 96 are locked into the same. Locking pin 94 and retaining pin 96 are made out of an elastic material which will permit the prongs 94*a* and 94*b* and 96*a* and 96*b* to be squeezed together, yet will rebound to their original shape after locking pin 94 and retaining pin 96 have cleared the interior edges of locking insert 92 and retaining insert 90

Spring 116 is a simple coil of metal which can be placed in compression and torsion. It is shown in a position in which it is at rest in FIG. 8A. At rest, the top end 116*a* of spring 1!6 and the bottom end 116*b* lie along approximately the same axis. In use, spring 116 is compressed and the ends 116*a* and 116*b* are turned approximately 180 degrees in the direction the shells turn when closing so that it will tend to urge shells 22 and 24 open.

In the preferred embodiment of the present invention, the majority of the component parts of the key case are made of injection molded Acrylonitrile-Butadiene-Styrene (ABS) plastic. It is intended that the top and bottom shells 22 and 24 be relatively inflexible in order to maintain the integrity of the keys within. Bottom shell 24 can be molded out of ABS plastic integrally with top and bottom cylindrical portions 68 and 68*a* as in the preferred embodiment of the same, or top and bottom cylindrical portions 68 and 68*a* can be separately molded and then affixed to bottom shell 24. The same procedures can be applied for manufacturing top shell 22 and central cylindrical portion 70. The liners 78 and 78*a* are made of injection molded thermoplastic rubber, and are affixed to the insides of shells 22 and 24 respectively with a suitable double-sided adhesive tape. Arms 34 and 36 are molded as part of liner 78*a* which fits into bottom shell 24, however, it is contemplated that the arms can be made separate from, or even out of a different material than bottom shell 24. Threaded receptacles 82 and 82*a* are made of aluminum or other suitable material, and in this embodiment of the invention are placed into the mold used to form liner 78*a*, and liner 78*a* is then molded around the threaded receptacles. Domed portions 80 and 80*a* are made of material which accumulates over the ends of the threaded receptacles on the back of arms 34 and 36 during the molding or other manufacturing process and serve to reinforce the connection of the threaded receptacles to the arms. Both retaining insert 90 and locking insert 92 are made of injection molded ABS plastic. Spring 116 can be made of any suitable metal which can be placed in compression and torsion. Locking pin 94 and retaining pin 96 are made of injection molded Nylon to give them the flexibility needed to allow their legs to be squeezed together to fit inside the locking insert 92 and retaining insert 90. Bolts 42 and 42*a* are standard bolts with knurled heads which permits them to be alternately loosened and tightened by hand without the aid of tools.

The first step in assembling hinge 26 is to insert retaining insert 90 and locking insert 92 into the respective bottom end 114*a* and top end 114 of the central cylindrical portion 70 in such a manner that the channel 102 on the outside wall of retaining insert 90 and channel 100 on the outside wall of locking insert 92 fit into the respective key ways 98*a* and 98 inside central cylindrical portion 70. It will thus be assured that the retaining insert 90 and the locking insert 92 will not rotate relative to the central cylindrical portion 70. This assembly, which will be referrred to as the central cylindrical assembly, is then brought into alignment with the two cylindrical portions 68 and 68*a* so they can be fit together.

When the central cylindrical assembly has been brought into alignment with, and is in between cylindrical portions 68 and 68*a*, the bottom end 116*b* of spring 116 is then inserted into hole 112 in wall 110 inside of central cylindrical portion 70. At this point, and before describing the assembly of the remaining parts of the hinge 26, several items are worth noting. First, although the hinge is shown in an open position in the exploded view, it is generally preferable to assemble the hinge 26 in a closed position. The remainder of the description of the assembly of the hinge 26 will assume that the shells are closed, and shell 22 has been turned in a counterclockwise direction and has been placed on top of shell 24 as it would be in use. Second, the orientation of several parts of the hinge in FIG. 8A as shown is slightly different from the position these parts will occupy in the assembled hinge. The reason for this is that it was necessary to turn some parts slightly to illustrate all of their features. These slight differences will be noted in the description which follows.

After the bottom end 116*b* of the spring has been inserted into the hole 112 in wall 110, the top end 116*a* of spring 116 is then fit into a hole or a groove 136 (first seen in FIG. 10) in locking pin 94. Locking pin 94 is then moved into position for insertion through top cylindrical portion 68 and into the top end 114 of central cylindrical portion 70. In order to fit the locking pin 94 into the top end of cylindrical portion 68, several things have to be done. First, the locking pin 94 which is now attached to top end 116*a* of spring 116, is rotated approximately 180 degrees in a counterclockwise direction. This brings the channels 122 on the outside of locking pin 94 into alignment with key ways 124 on the inside of cylindrical portion 68. Next, the prongs 94 and 94*a* on the bottom end of the locking pin 94 have to be squeezed together so the lip 130 around the bottom end of the locking pin 94 will clear the inside diameter of cylindrical portion 68. Locking pin 94 is then inserted through cylindrical portion 68 and locking insert 92 into top end 114 of central cylindrical portion 70. When channels 122 on the outside of locking pin 94 are aligned with key ways 124 on the inside of cylindrical portion 70 in such a mannner, knob 104*a* on the bottom end of locking pin 94 fits into notch 104 on bottom end of locking insert 92 and spring 116 is in a compressed and wound condition.

The last part to be assembled is retaining pin 96. In order to fit the same into the bottom end of cylindrical portion 68*a*, the prongs 96*a* and 96*b* on top end of retaining pin 96 are squeezed together so the lip around the top end will clear the inside diameter of cylindrical portion 68*a* and the inside diameter of retaining insert 90. The retaining pin 96 will be pushed into cylindrical portion 68*a* as far as it can go, to the point where the inside of cap 128 on retaining pin 96 will come in contact with the ledge 134*a* on the bottom end of cylindrical portion 68*a*. At this point, the lip 132 on the end of the retaining pin 96 will have cleared the top end of the retaining insert 90 and prongs 96*a* and 96*b* will separate to lock the hinge assembly in place.

The hinge 26 operates in the following mannner. When button 30 is not depressed, the alignment of the knob 104*a* on the bottom of the locking pin 94 is engaged with the notch 104 on the bottom of the locking insert 92. This prevents cylindrical portions 68 and 68*a* and central cylindrical portion 70 from rotating relative to each other. Shells 22 and 24 are therefore prevented from opening. When it is desired to open key holder 20, button 30 is depressed. This compresses spring 116 until knob 104*a* clears notch 104 on end of locking pin 94. Once knob 104*a* completely clears notch 104, the entire central cylindrical assembly is free to rotate with respect to cylindrical portions 68 and 68*a*. The disengagement of the knob 104*a* with the notch 104 also releases the tension in spring 116, which causes it to rotate, as seen in this view, in a clockwise direction, opening shells 22 and 24. To close key holder 20, shells 22 and 24 are closed together until knob 104*a* once again aligns with notch 104, thereby locking shells 22 and 24 together.

Figure 10:
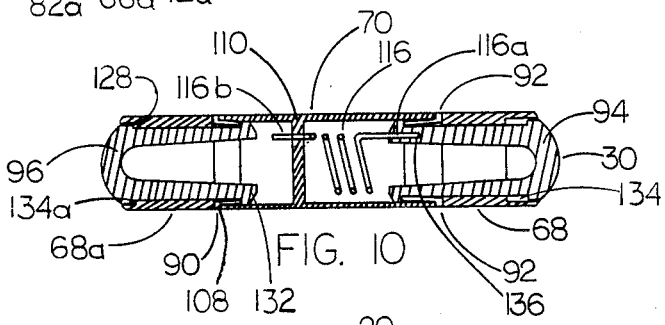
FIG. 10 is a cross-sectional view taken along line 10—10 of FIG. 9 which shows the details of the hinge of the present invention as assembled.
Figure 9:
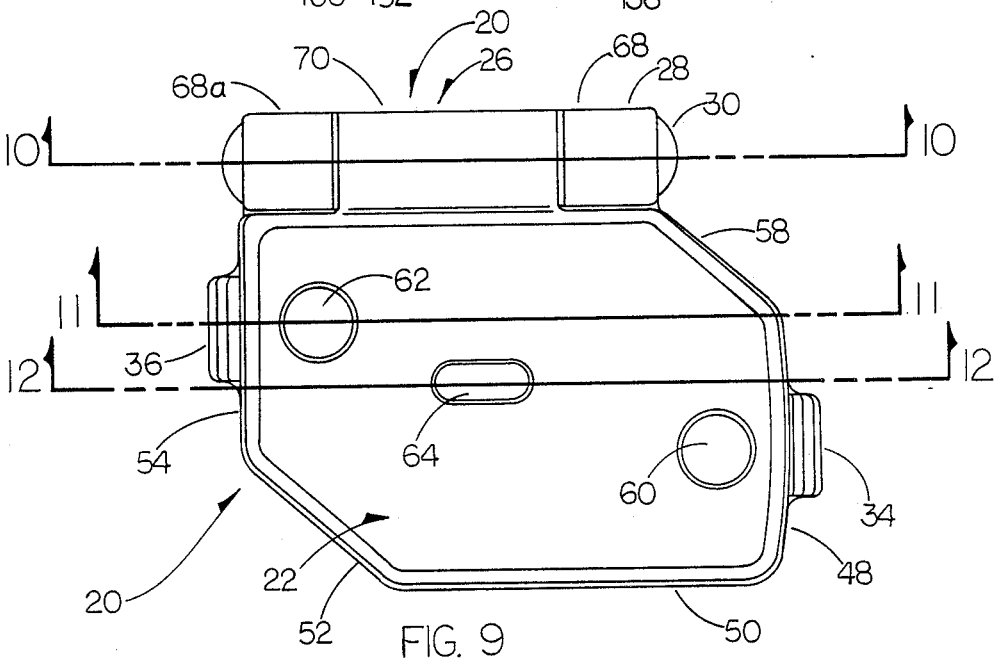
FIG. 9 is plan view of the key holder of the present invention which is identical to that of FIG. 3, without the hand drawn in, which is used to illustrate the lines along which the following three sectional views are taken.

FIG. 10 on the following page is a cross-sectional view taken along line 10—10 of FIG. 9 which shows the details of the hinge 26 as assembled. The side of hinge 26 in FIG. 10 which is to the left of wall 110 will be examined first since the sectional view of the right side is fairly similar to it in structure with a few additional variations. It is seen that cylindrical portion 68*a* has a ledge 134*a* around its circumference at the bottom end thereof upon which cap 128 of retaining pin 96 rests so the retaining pin 96 will not be drawn inside cylindrical portion 68*a*. The inside diameters of both retaining insert 90 and bottom cylindrical portion 68*a* are approximately equal. The outside diameter of retaining pin 96 is slightly less than the inside diameter of both cylindrical portion 68*a* and retaining insert 90 so the retaining pin 96 may be slipped inside of both cylindrical portion 68*a* and retaining insert 90. The top or, as seen in this figure, the right edge of cylindrical portion 68*a* rests on the bottom edge or lip 108 of retaining insert 90. Retaining insert 90 appears as a pair of "L"- shaped elements on the top of and below retaining pin 96 in cross section. The lip 108 around the perimeter of the bottom end of retaining insert 90 rests on the bottom end of central cylindrical portion 70, and the top end of retaining insert 90 rests on the inside of the lip 132 of retaining pin 96. As described above, when prongs 96*a* and 96*b* on the end of retaining pin 96, shown generally in FIG. 10, have rebounded to their normal position, due to the relationship between the various parts described above, and the fact that they are held together against longitudinal movement relative to each other, bottom cylindrical portion 68*a* is locked firmly in place with central cylindrical portion 70 and the rest of the central cylindrical assembly.

Looking at the center and right side of FIG. 10, it is seen that one end 116*b* of spring 116 passes through hole 112 in wall 110 and the other end 116*a* fits into hole or groove 136 in locking pin 94. Otherwise, the right side of the hinge 26 in section appears the same as the left side with the exception of the previously-mentioned fact that the ledge 134 on top cylindrical portion 68 is recessed further toward the center of the hinge 26 to allow for more longitudinal movement of the button 30 on the end of locking pin 94.

Figure 11:
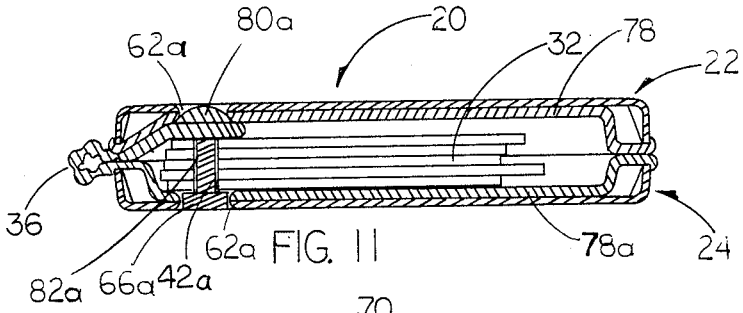
FIG. 11 is a cross-sectional view taken on line 11—11 which passes through one of the circular holes in the exterior of the top shell which illustrates the manner in which the holes provided in the top and bottom shells provide a mechanism for locking the arms in place inside the key holder; and, FIG. 12 is a cross-sectional view taken along line 12—12 of FIG. 9 which passes through the boss in the center of the top shell to show the air pockets formed between the shells and the liners.

FIG. 11 is a cross-sectional view taken through bolt 42*a* and threaded receptacle 82*a* which further illustrates the manner in which the arms, here arm 36, are locked to the inside of the key holder 20 at both the top and bottom of the same to prevent the keys 32 from moving and rattling inside. At the top of the key holder 20, domed portion 80*a* on the end of threaded receptacle 82*a* and at the bottom, head 66*a* of bolt 42*a*, are held in place and kept from moving by the portions of the shells 22 and 24, and the liners 78 and 78*a* surrounding holes 62 and 62*a*, respectively. FIG. 11 also shows one of the arms, here arm 36, in its folded position inside of the shells 22 and 24. As seen in FIG. 11, the height of the entire fastening assembly, which consists of bolt 42*a* and threaded receptacle 82*a*, is approximately equal to the height of the key holder 20 when laid flat.

Figure 12:
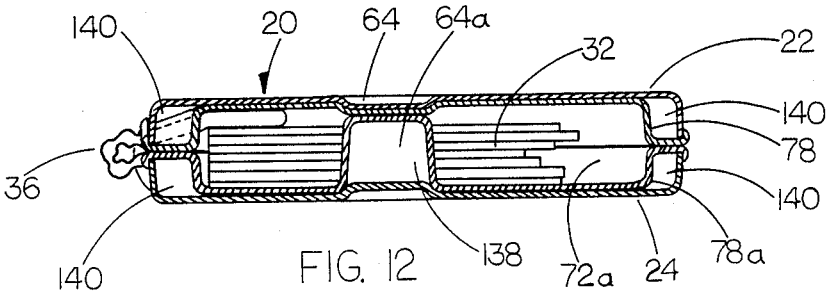

The final figure, FIG. 12, is a cross-sectional view taken along lines 12—12 of FIG. 9 which pass through bosses 64 and 64*a*. FIG. 12 shows the air pockets 138 formed by bosses 64 and 64*a*, and the air pockets 140 formed between the shells 22 and 24 and the liners 78 and 78*a* which serve as an additional means tO keep the keys from making noise when they are inside the key holder 20.

It is to be understood that the form of the invention shown in the accompanying drawings and described in this specification is the preferred example of the same, and this invention is not limited to the exact arrangement of parts shown or described, and various changes in the details of construction as to size, shape, nd arrangement of parts may be made without departing from the spirit of the invention, the scope of the novel concepts of the invention, or the scope of the following claims.

What is claimed is:

1. A key holder for holding keys comprising a pair of shells for enclosing keys;

at least one arm attached to at least one of said shells for holding said keys;

a hinge connecting the shells together to allow the shells to open and close relative to each other wherein said hinge is comprised of three hollow cylindrical portions one of which has a notch on an interior portion thereof and a spring within said hinge which when wound tends to urge the shells open;

said three cylindrical portions comprising a top cylindrical portion and a bottom cylindrical portion both of which are connected to one of said shells and a central cylindrical portion connected to the other shell and which lies in between the top cylindrical portion and the bottom cylindrical portion;

a body which is generally cylindrical in shape and fits inside the three hollow cylindrical portions and is able to move longitudinally therein; and wherein the means for locking the hinge is a projection on the outside of the body which fits into the notch inside one of said cylindrical portions so that the hinge and shells are locked when the projection fits into the notch and when the body is moved so that the projection moves out of the notch, the spring releases to allow the hinge and shells to open.

2. A key holder as in claim 1, further comprised of at least one liner placed inside the shells in such a manner that air pockets are formed between the keys and the shells to reduce the noise made by the keys.

* * * * *